US007128605B2

(12) United States Patent
Montena

(10) Patent No.: US 7,128,605 B2
(45) Date of Patent: Oct. 31, 2006

(54) COAXIAL CABLE CONNECTOR ASSEMBLY

(75) Inventor: Noah P. Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/037,743

(22) Filed: Jan. 18, 2005

(65) Prior Publication Data

US 2006/0160417 A1 Jul. 20, 2006

(51) Int. Cl.
*H01R 9/05* (2006.01)

(52) U.S. Cl. ..... 439/578; 439/133; 439/308

(58) Field of Classification Search ..... 439/578, 439/308, 304, 306, 133, 367, 301–302
See application file for complete search history.

(56) References Cited

U.S. PATENT DOCUMENTS

| | | | | |
|---|---|---|---|---|
| 3,155,448 | A | 11/1964 | Korsgren | 339/201 |
| 3,358,266 | A * | 12/1967 | Chandler et al. | 439/717 |
| 3,383,642 | A * | 5/1968 | Nava et al. | 439/724 |
| 3,474,385 | A * | 10/1969 | Cefarelli et al. | 439/295 |
| 4,053,195 | A | 10/1977 | Laverick et al. | 339/37 |
| 4,163,594 | A | 8/1979 | Aujla | 339/82 |
| 4,173,385 | A | 11/1979 | Fenn et al. | 339/177 |
| 4,676,572 | A * | 6/1987 | Booker | 439/301 |
| 5,055,060 | A | 10/1991 | Down et al. | 439/304 |
| 5,564,938 | A | 10/1996 | Shenkal et al. | 439/301 |
| 5,580,261 | A * | 12/1996 | Meynier | 439/188 |
| 5,775,960 | A * | 7/1998 | Saito et al. | 439/843 |
| 5,816,853 | A | 10/1998 | Buekers et al. | 439/521 |
| 5,865,654 | A * | 2/1999 | Shimirak et al. | 439/852 |
| 5,897,404 | A * | 4/1999 | Goodman et al. | 439/843 |
| 6,086,434 | A * | 7/2000 | Rollero et al. | 439/852 |
| 6,123,549 | A * | 9/2000 | Williams | 439/744 |
| 6,152,787 | A * | 11/2000 | Serbin et al. | 439/852 |
| 6,491,546 | B1 | 12/2002 | Perry | 439/620 |
| 6,773,304 | B1 * | 8/2004 | Conway et al. | 439/595 |
| 6,808,417 | B1 * | 10/2004 | Yoshida | 439/585 |

OTHER PUBLICATIONS

2 Page Disclosure of Conventional Co-axial Security Shield referred to in p. 2 of the specification.

* cited by examiner

*Primary Examiner*—Michael C. Zarroli
(74) *Attorney, Agent, or Firm*—Hooker & Habib, P.C.

(57) ABSTRACT

A coaxial connector assembly includes a coaxial cable connector and a shield for the connector, the shield including spring fingers adjustably engaging the connector.

19 Claims, 3 Drawing Sheets

COAXIAL CABLE CONNECTOR ASSEMBLY

FIELD OF THE INVENTION

The invention relates to coaxial cable connector assemblies, particularly to coaxial cable connector assemblies that are mounted on threaded ports.

DESCRIPTION OF THE PRIOR ART

Coaxial cables are commonly used to transmit high-frequency television and computer signals from signal sources to end-users.

The cables include a central conductor for signal transmission and a surrounding grounding braid. Connectors are mounted on the ends of the cables to permit attachment to threaded metal contact ports for forming electrical connections between the braid and the port and the central conductor and a contact in the port. In CATV systems, taps are mounted on distribution cables and coaxial drop cables extend from the taps to individual residences. Connectors on the ends of drop cables are connected to threaded ports on taps on the distribution cable.

It is difficult to maintain the security of coaxial cables connectors attached to threaded ports. Unauthorized individuals can remove the connectors from the ports. Signal quality can be degraded by improperly threading connectors on ports or by tampering with coaxial cables properly attached to ports.

Conventional security shields prevent tampering with coaxial cable connectors attached to tap ports. These shields are pushed over ports and are held in place by the connectors. A special installation wrench must be used to engage the connector to the port within the shield.

Therefore there is a need for a coaxial connector assembly for mounting on a contact port that provides protection against tampering, is easy to install without special tools, and can be installed on ports of different lengths.

SUMMARY OF THE INVENTION

The present invention is an inexpensive coaxial cable connector assembly that provides protection against tampering, is easy to install, and can be installed on ports of different lengths.

The coaxial cable connector assembly includes a cable connector with a nut that is threaded onto a contact port, a shield and boot surrounding the cable. The shield is slid along the cable and over the connector to protect the connection from tampering. The shield latches onto the connector to prevent movement away from the port. An optional boot may be fitted on to the trailing end of the shield. If desired, the nut may include an annular nut seal for forming a seal between the nut and the port.

The shield has a cylindrical inner shield member surrounded by a cylindrical outer shield member. The inner shield member includes one or more flexible fingers that latch on one of a number of retention surfaces on the coaxial cable connector to prevent the shield from being removed from the connector.

The shield is loosely mounted on the coaxial cable away from the cable connector during threading of the connector onto the port. After the connector has been fully threaded on the port, the shield is moved along the cable, over the connector to latch in place on the connector and against a plate which supports the port. The boot is made of flexible rubber or plastic and is attached to the trailing end of the shield to prevent moisture and other contaminants from entering the shield. For use indoors, the boot may be eliminated.

Other objects and features of the invention will become apparent as the description proceeds, especially when taken in conjunction with the accompanying three sheets of drawings illustrating the invention.

DESCRIPTION OF THE PREFERRED EMBODIMENT

Figure 1:
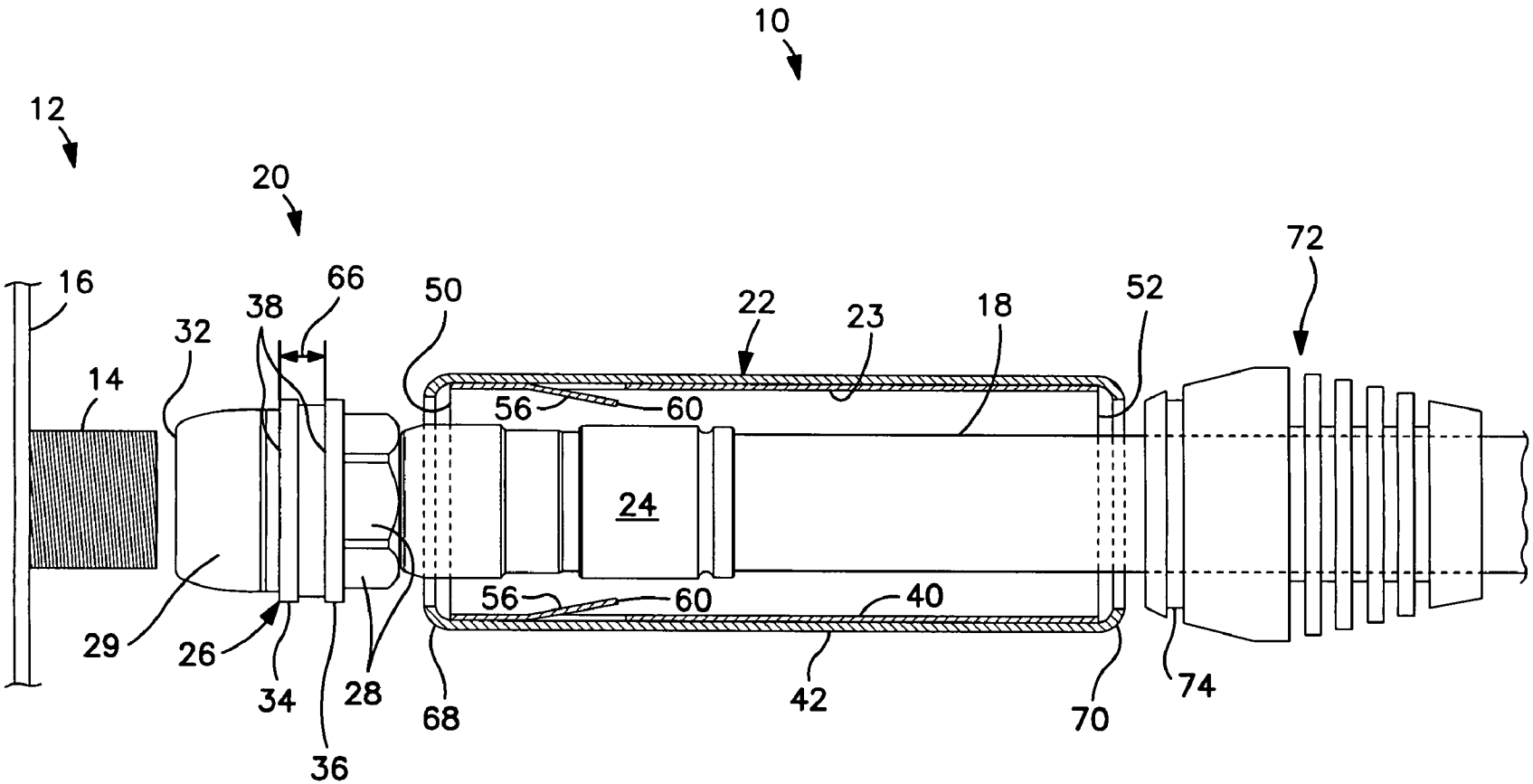
FIG. 1 is a cut away view of the coaxial cable connector assembly before it is mounted on a port.

Coaxial cable connector assembly 10 is mounted on tap assembly 12. Tap assembly 12 includes a threaded coaxial cable mounting port 14 and a tap plate 16 that supports the port. Port 14 extends perpendicularly away from tap plate 16. The port includes a central contact for forming an electrical connection with the central conductor wire of a coaxial cable mounted on the tap assembly.

Connector assembly 10 is mounted on one end of coaxial cable 18 and includes coaxial cable connector 20 and tubular shield 22 which surrounds the connector. Cable 18 includes a central conductor wire and a ground braid surrounding the wire. Connector 20 includes a sleeve 24 mounted on the end of coaxial cable 18 and in electrical connection with the braid in the cable and a mounting nut 26.

Nut 26 is rotatably mounted on the lead end of sleeve 24 and includes interior threads (not illustrated) engagable with threads on port 14. The central wire in cable 18 extends into the nut for engaging the contact in port 14. Nut 26 includes a number of flat tool-engaging surfaces 28 spaced around the nut. A tool may be mounted on surfaces 28 to facilitate tightening the nut on port 14. The nut is threaded onto the port a sufficient distance to establish an electrical connection between the central wire and the contact in the port and between the nut and threaded port.

Annular seal member 29 is mounted on the lead end of nut 26. Seal member 29 is formed from a resilient rubber material and forms a tight seal with port 14 when the nut is threaded onto the port. This seal protects the interior of the connector from moisture and contaminants. The connector 20 and seal member 29 are disclosed more fully in co-pending U.S. patent application for Nut Seal Assembly for Coaxial Connector, No. 10/876,386 filed Jun. 25, 2004 and published Aug. 11, 2005 as Pub. No. 2005/0176294, the disclosure of which is incorporated herein by reference in its entirety.

Connector assembly 10 is adapted to be mounted on tap assemblies with different length threaded ports 14. The distance 30 between the lead end 32 of the seal member 29 when mounted on a port 14 and the plate 16 supporting the port will vary depending upon the length of the port.

Nut 26 includes two circumferential locking ridges or rings 34 and 36 which extend around the nut and are spaced apart a short axial distance. Ridges or rings 34 and 36 are located between surfaces 28 and the lead end 32 of the nut. Each ridge defines a latch retention surface 38 facing toward lead end 32. Surfaces 38 are spaced apart axial distance 66 and form latch retention portions on the outer surface of coaxial cable connector 20.

Tubular shield 22 has a generally tubular body 23 extending between the lead and trailing ends of the shield. Shield 22 includes tubular metal inner shield member 40 surrounded by tubular metal outer shield member 42. Inner member 40 is rolled from sheet metal pre-form 44 shown in FIG. 2. The pre-form includes a flat rectangular sheet metal body 46 having opposed side edges 48, lead edge 50 and trailing edge 52. Two pairs of flexible latch fingers 54, 56 are cut from body 46. Each finger 54, 56 includes opposed side edges 58, a trailing end or latch surface 60 and a lead end 62 integral with the remainder of body 46. Side edges 58 and latch ends 60 are cut from body 46.

The inner shield member 40 is formed by rolling pre-form 44 into a tube with edges 48 abutting each other. The flexible fingers 54 and 56 are bent into the interior of the tube with the latch ends 60 extending away from lead edge 50.

Figure 2:
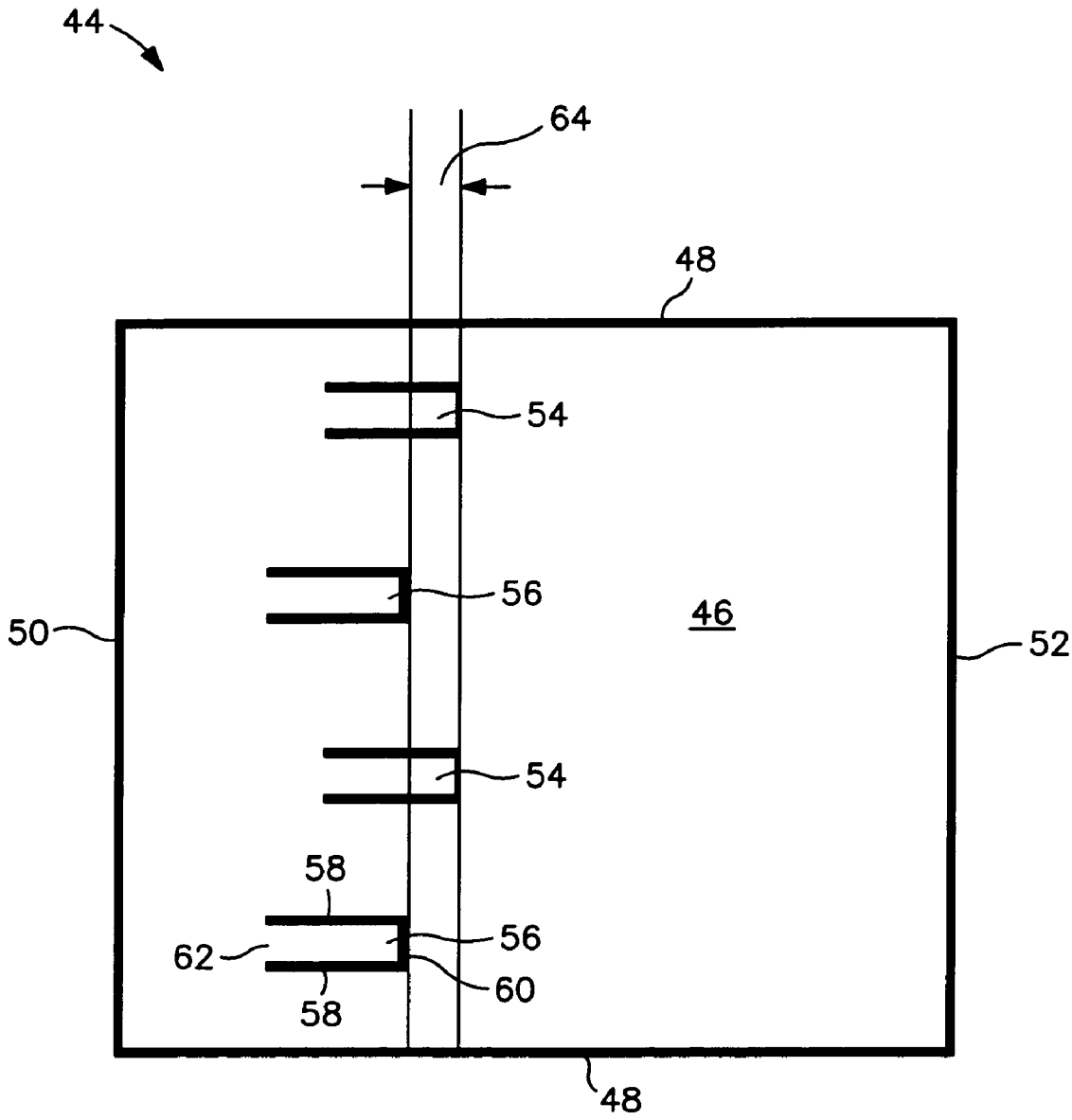
FIG. 2 is a plan view of a pre-form for an inner shield member before being rolled into a tubular shape.
Figure 3:
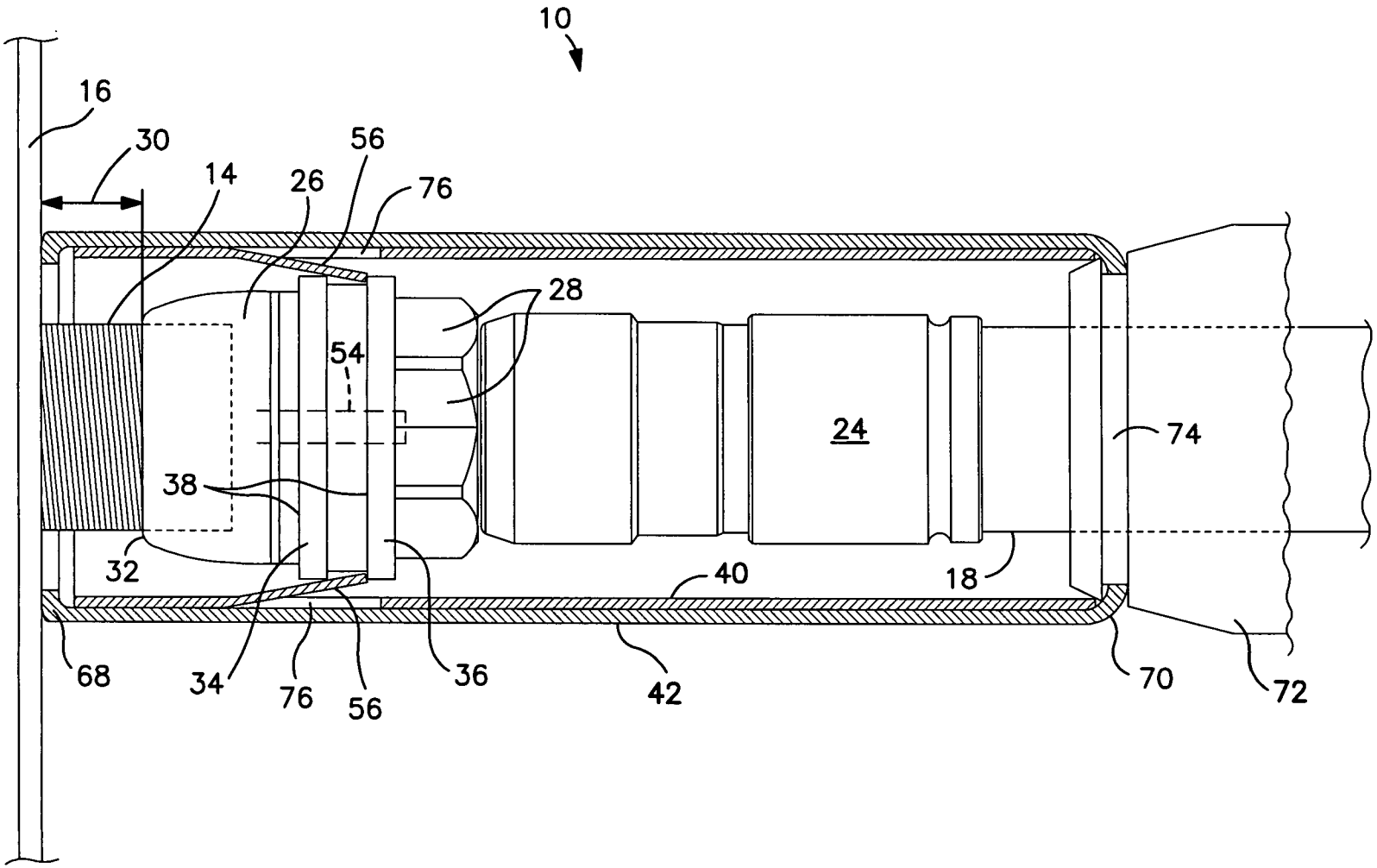
FIG. 3 is a cut away view of the coaxial cable connector assembly after it has been mounted on a port.

As shown in FIG. 2, the ends 60 of fingers 54 and 56 are spaced apart an axial distance 64 with the ends of fingers 56 nearer end 50 than the ends of fingers 54. The ends of fingers 56 are separated from the ends of fingers 54 by axial distance 64. Distance 64 is about one half the axial distance 66 between latch retention surfaces 38 on nut 22. See FIGS. 1 and 2.

Fingers 54, 56 are bent into the interior of tubular member 40 with the latch ends 60 of each pair of fingers 54, 56 spaced apart across member 40 a distance less then the diameter of ridges or rings 34 and 36. Fingers 54 and fingers 56 are located 180 degrees across from each other on member 40.

Strong seam-free metal outer tubular member 42 is fitted tightly around inner tubular inner member 40 and has an axial length greater than the length of inner member 40 so that lead and trailing ends 68 and 70 extend beyond the ends of the inner member. The ends 68 and 70 are formed radially inwardly to overlie the ends of the inner member. If desired, ends 68 and 70 may be formed radially inwardly past the ends of the inner member as illustrated in FIG. 1.

Tubular shield 22 is loosely mounted on cable 18 adjacent coaxial cable connector 20 prior to threading the connector onto port 14. Boot 72 is mounted on the cable for connection to the trailing end of shield 22 to form a weather seal between the cable and the trailing end of the shield. Boot 72 has an annular shape and closely surrounds cable 18. The boot includes a circumferential latch groove 74 at the lead end thereof. Trailing end 70 of outer shield member 42 fits in groove 74 to form a seal between the boot and tubular shield 22. The sliding fit between the boot and cable 18 permits free movement of the boot along cable 18.

Mounting of coaxial cable 10 on a threaded port 14 extending from tap plate 16 will now be described.

The assembly 10 is positioned as shown in FIG. 1 with mounting nut 26 positioned a short distance outwardly from the end of the port and the assembly in axial alignment with the port. The nut is then moved into engagement with the port and rotated to thread the nut onto the port until the nut is hand tight. The nut is then fully tightened onto the port using a conventional tightening tool, such as an end wrench, which engages surfaces 28. Member 29 seals against the port.

Next, shield 22, with boot 72 engaged or disengaged, is moved axially along the cable, over coaxial cable connector 20 and toward plate 16. During movement of the shield toward plate 16 the latch fingers 54, 56 are moved along nut 26 and toward the plate. The latch ends 60 of lead fingers 56 move past trailing ridge 36. The ridge elastically flexes the fingers radially outwardly toward shield member 40. After the fingers pass the ridge they snap back or latch behind retention surface 38 of ridge 36. Further movement of the shield toward plate 36 may move fingers 54 past ridge 36 so that the ends 60 of fingers 54 snap back or latch behind surface 38 of the ridge. Continued movement of the tubular shield toward plate 16 may move fingers 54 and 56 beyond ridge 34 so that the ends of the fingers pass ridge 34 and snap back or latch against surface 38 of ridge 34.

The two ridges and two sets of fingers are axially spaced along the connector assembly to provide latching of the shield onto the nut with the lead end of the outer shield member against or closely adjacent plate 16, independent of the length of the port 14 and the position of the nut on the port. The two axially spaced latch retention surfaces 38 on the nut and axially spaced fingers on the tubular shield facilitate hand latching of the shield onto the coaxial cable connector. If desired, the connector assembly may include a single latch retention surface on the nut and two or more latch fingers on the shield. The assembly 10 may include a plurality of latch retention surfaces on the nut and a single latch finger on the shield. After shield 22 has engaged nut 26, boot 72 may be engaged onto trailing end 70. The latch retention surfaces are located between nut 26 and sleeve 24.

If desired, nut 26 may be removed from port 14 through use of a tool. The tool may be a wrench with a thin, elongate socket having an open side permitting fitting of the socket on cable 18 between the shield 22 and withdrawn boot 72. The socket is extended along the cable into the shield 22 and forwardly to engage surfaces 28 of nut 26. The wrench includes a handle permitting manual rotation of the socket to remove the nut from port 14.

When connector assembly 10 is mounted on tap 12 as described, the shield protects the coaxial cable connector 20 from unauthorized tampering. Attempts to unthread the coaxial cable connector from the port by rotating shield 22 do not rotate the nut. Rather, the fingers holding the shield in place on the connector rotate around the engaged surface 24 without unthreading the nut. The seam-free and imperforate outer shield member 42 completely surrounds the metal inner shield member 40 to conceal the finger cut-outs 76 and the seam at abutting side edges 48 from tampering.

While I have illustrated and described preferred embodiments of my invention, it is understood that this is capable of modification, and I therefore do not wish to be limited to the precise details set forth, but desire to avail myself of such changes and alterations as fall within the purview of the following claims.

I claim:

1. A coaxial cable connector assembly comprising:

a coaxial cable connector having a lead end, a trailing end and an outer connector surface extending between the ends, the outer connector surface having a first latch retention surface facing the lead end of the connector and extending around the connector; and a tubular shield mounted over and surrounding the coaxial cable connector, the shield having a metal body with a lead end adjacent the connector lead end, a trailing end adjacent the connector trailing end, an outer shield surface, an inner shield portion, and a first latch member, the first latch member comprising a flexible metal finger integral with the metal body and extending from the inner shield portion inwardly toward the connector, the finger having a lead end joined to the metal body, a trailing end extending toward the trailing end of the metal body, and a latch surface at the trailing end of the finger, the latch surface contacting the first latch retention surface in latched engagement to prevent movement of the shield along the connector and permit movement of the shield around the connector.

2. The coaxial cable connector assembly of claim 1 wherein the connector includes flat tool-engaging surfaces and a sleeve, the tool-engaging surfaces located on the nut between the latch retention surface and the sleeve.

3. The coaxial cable connector assembly of claim 1 wherein the shield includes a second latch member axially spaced from the first latch member.

4. A coaxial cable connector assembly comprising:

a coaxial cable connector having an outer connector surface, the outer connector surface having a first latch retention portion thereon; and a tubular shield mounted over the coaxial cable connector, the shield having A) a metal member, said metal member having a lead end, a trailing end, an outer shield surface, an inner shield portion, and a first latch finger integral with the metal member for engagement with the latch retention portion of the coaxial cable connector, the finger having a lead end joined to the metal member and a trailing end extending toward the trailing end of the metal member, and B) a tubular member surrounding the metal member, wherein the tubular member protects the connector from tampering.

5. The coaxial cable connector assembly of claim 4 wherein the tubular member comprises an imperforate metal tube.

6. A coaxial cable connector assembly comprising:

a coaxial cable connector having an outer connector surface, the outer connector surface having a first latch retention portion thereon; and a tubular shield mounted over the coaxial cable connector, the shield having a metal body, the body having a lead end, a trailing end, an outer shield surface, an inner shield portion, and a first latch finger integral with the metal body for engagement with the latch retention portion of the coaxial cable connector, the finger having a lead end joined to the shield body and a trailing end extending toward the trailing end of the body, the shield comprising a tubular inner shield member and an imperforate tubular outer shield member, the outer shield member surrounding the inner shield member, the inner shield member comprising said latch finger.

7. A coaxial cable shield for use on the outer surface of and a coaxial cable connector, the shield comprising:

a generally tubular first body having an outer surface and an inner portion, the shield having first and second latch members, said latch members spaced apart along the first body, each latch member extending from the inner portion in the same direction along the first body for latched engagement with the outer surface of the coaxial cable connector in one of two positions.

8. The coaxial cable shield of claim 7 wherein each latch member includes a lead latch end joined to the shield, a trailing latch end and a flexible finger extending between such ends.

9. The coaxial cable shield of claim 7 wherein each latch member comprises a metal finger.

10. The coaxial cable shield of claim 7 including a seam-free second tubular body surrounding said first body.

11. A coaxial cable shield and a coaxial cable connector assembly, the shield comprising:

a first generally tubular member having an outer surface, an inner portion, a first latch member engaging a portion of an outer surface of the coaxial cable connector, and opposite ends;

a seam free second tubular member surrounding the first tubular member and extending beyond the ends of the first tubular member, both said tubular members formed from metal;

said first latch member comprising a flexible metal finger extending from the first tubular member.

12. A coaxial cable connector assembly comprising a coaxial cable connector; and a generally tubular shield surrounding the coaxial cable connector, the connector having a lead and a trailing end, the shield having a lead end and a trailing end; the connector including first means for engaging a port, and second means for mounting the connector on a coaxial cable; and a latch connection between the shield and connector formed after the connector has been mated to the port by movement of the shield from a position remote from the port toward the port and over the connector, the connection preventing movement of the shield away from the port, the latch connection including a first surface on the shield facing away from the port, a second surface on the connector facing toward the port, and a flexible latch finger on one of said shield and connector, the latch finger having a free end defining one of said surfaces, said free end engaging the other of said surfaces.

13. The coaxial cable connector assembly as in claim 12 wherein said first means comprises a threaded nut rotatably mounted on said second means, and said second means comprises a coaxial cable mounting sleeve.

14. The coaxial cable connector assembly of claim 12 wherein the shield comprises a first tubular body inside a second tubular body, and said finger is an integral part of said first tubular body.

15. The coaxial cable connector assembly of claim 12 wherein the latch connection includes a plurality of fingers integral with the shield.

16. A method of mounting a coaxial cable connector assembly to a threaded coaxial cable port comprising the steps of:

(a) providing a threaded coaxial cable mounting port extending from a plate;

(b) providing a coaxial cable connector secured to a coaxial cable and including a rotatable nut;

(c) providing a tubular coaxial cable connector shield on the cable away from the coaxial cable connector;

(d) rotating the nut onto the port to form a connection between the coaxial cable connector and the port; and (e) moving the shield toward the port and over the coaxial cable connector to position the shield around the coaxial cable connector with the lead end of the shield against or closely adjacent the plate, and forming a latch connection between the shield and the coaxial cable connector to prevent movement of the shield away from the plate.

17. The method of claim 16 including the step of:

(f) locating the shield at one of a number of latch positions relative to the coaxial cable connector depending on the distance between the lead end of the coaxial cable connector and the plate.

18. The method of claim 16 including the step of:

(f) rotating the shield around the coaxial cable connector without disengaging the latch connection or rotating the nut.

19. A coaxial cable connector assembly comprising:

a coaxial cable connector having an outer connector surface, the outer connector surface having a first latch retention portion thereon; and a tubular shield mounted over the coaxial cable connector, the shield having an outer shield surface, an inner shield portion, and a first latch member extending from the inner shield portion toward the connector for latched engagement with the latch retention portion on the coaxial cable connector, the connector including a second latch retention portion axially spaced from the first latch retention portion.

* * * * *